US005370591A

United States Patent [19]

Jewell et al.

[11] Patent Number: 5,370,591

[45] Date of Patent: Dec. 6, 1994

[54] TRAINING VAULTING BOARD

[75] Inventors: Wayne F. Jewell, Los Gatos; Richard D. Kees, Penngrove, both of Calif.

[73] Assignee: Trampolines Unlimited, Inc., Los Gatos, Calif.

[21] Appl. No.: 126,487

[22] Filed: Sep. 24, 1993

[51] Int. Cl.[5] ..... A63B 5/08; A63B 5/11

[52] U.S. Cl. ..... 482/30; 482/26; 482/27

[58] Field of Search ..... 482/30, 31, 32, 26, 482/27, 28, 29

[56] References Cited

U.S. PATENT DOCUMENTS

| | | | |
|---|---|---|---|
| 2,590,049 | 3/1952 | Sidlinger | 482/28 |
| 3,156,318 | 11/1964 | Sorenson et al. | 482/28 |
| 3,310,305 | 3/1967 | Howe | 482/29 |
| 3,367,661 | 2/1968 | Dean, Jr. | 482/27 |
| 3,983,585 | 10/1976 | Sidlinger | 482/27 |
| 4,045,021 | 8/1977 | Nissen | 482/29 |
| 4,474,369 | 10/1984 | Gordon | 482/27 |

*Primary Examiner*—Richard J. Apley
*Assistant Examiner*—Lynne A. Reichard
*Attorney, Agent, or Firm*—Thomas E. Schatzel

[57] ABSTRACT

A vaulting board including ramp framing with a pliable bed sheet within the interior confines of the framing and interconnected to the framing by resilient connector means.

10 Claims, 1 Drawing Sheet

TRAINING VAULTING BOARD

BACKGROUND OF THE INVENTION

1. Field of the Invention

The present invention relates generally to vaulting boards for gymnastic athletes, and more particularly to a training vaulting board.

2. Description of the Prior Art

In gymnastics, many events call for the athlete to commence a performance by running and jumping on a vaulting board which is in turn designed to assist and accelerate the athlete's jump. The vaulting board in general comprises an incline ramp-type board with springs positioned about the underside. Thus, as the athlete jumps onto the board, the springs compress and then expand to urge and assist the athlete in a vertical direction. Upon jumping onto the board, the athlete's ankles, lower legs, knees and hips are all subjected to a high degree of impact forces. Consequently, each repetition by the athlete of the vaulting board exposes the athlete's lower body to substantial impact trauma tending to cause muscle tears, shin splits, ankle injuries, knee injuries, hip injuries, etc. Consequently, the trauma induced by a conventional vaulting board limits the activities of an athlete returning to action after partially recuperating from a previous injury. Likewise, an athlete attempting to design and practice new routines is limited in the number of repetitions that can be performed in a given period of time due to the trauma exposed by the repeated jumping onto the conventional vaulting board. Also, due to the trauma, many would-be athletes lose interest in events requiring use of a vaulting board.

Accordingly, there is a need for a vaulting board that can be used in training which does not subject the athlete to the degree of traumatic impact as presented by the conventional vaulting board.

SUMMARY OF THE INVENTION

An object of the present invention is to provide a vaulting board for athletes which imposed reduced traumatic impact compared to that of conventional vaulting boards, Another object of the present invention is to provide a training vaulting board which can be used by athletes repeatedly in practicing routines without imposing the traumatic impact of a conventional vaulting board, Another object of the present invention is to provide a vaulting board which can be utilized by an athlete recuperating from an injury without subjecting the body to the traumatic impacts of a conventional vaulting board, Briefly, the training vaulting board of the present invention includes a ramp framing having a pair of lateral frames with each lateral frame connected at a first end to opposite ends of a first cross member and a second end to opposite ends of a second cross member with the second end of the frame being elevated relative to the first end. A first plurality of coil springs are connected laterally with each of the lateral frames, with the elevated cross member and with a pliable bed sheet positioned intermediate the lateral frames and the cross members. A pliable cover layer is positioned over the coil springs and extends laterally from the bed sheet to the lateral frames and cross members.

An advantage of the present invention is that it provides a vaulting board that presents less impact trauma to an athlete than that of a conventional vaulting board.

Another advantage of the present invention is that it provides a vaulting board which may be utilized by an athlete to repeatedly practice a routine without suffering the traumatic impact compared to that which the athlete would be exposed in utilizing a conventional vaulting board.

Another advantage of the present invention is that it provides a vaulting board which may be utilized by an athlete recuperating from an injury without being subjected to the traumatic impact that the athlete would otherwise be subjected with a conventional vaulting board.

These and other objects and advantages of the present invention will no doubt become obvious to those of ordinary skill in the art after having read the following detailed description of the preferred embodiment which is illustrated in the various drawing figures.

IN THE DRAWINGS

DETAILED DESCRIPTION OF THE PREFERRED EMBODIMENT

Figure 1:
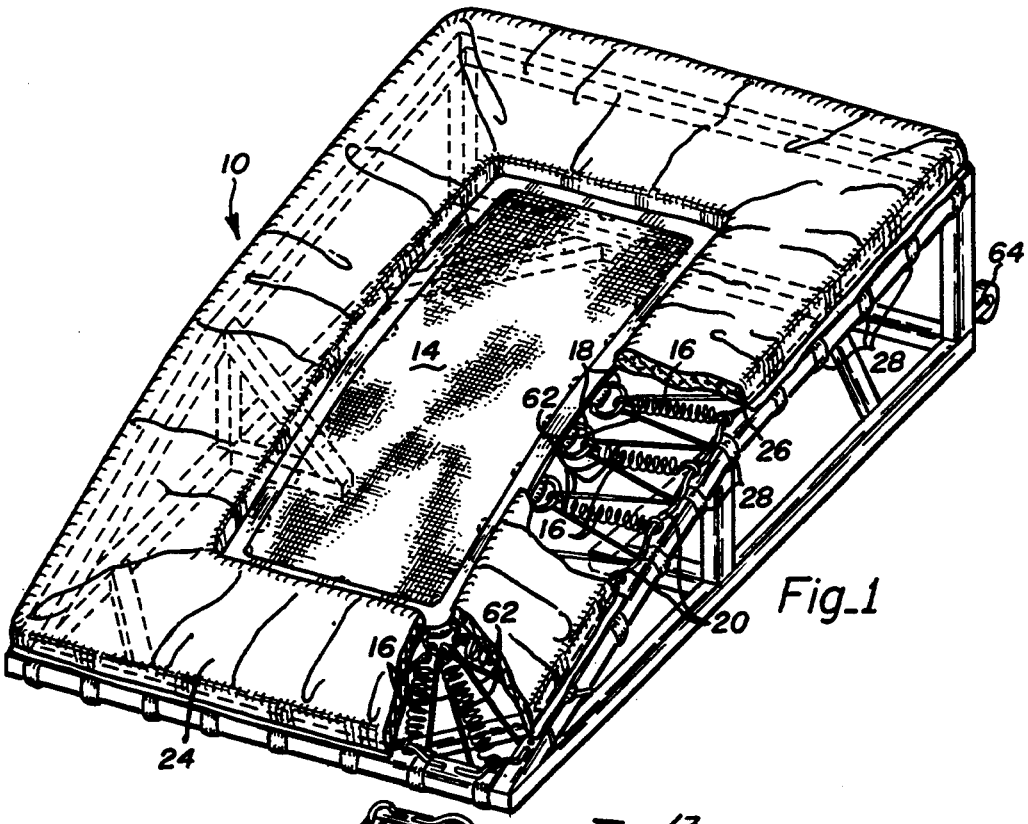
FIG. 1 is a perspective view of an embodiment of a vaulting board of the present invention.
Figure 2:
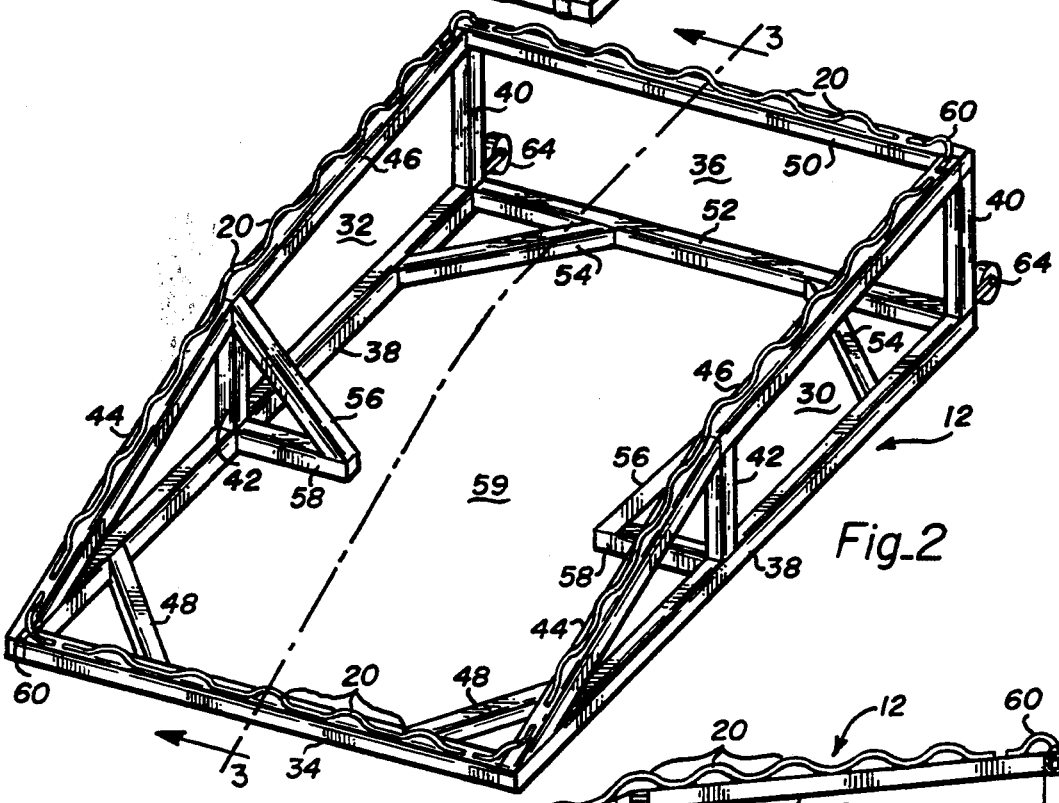
FIG. 2 is a perspective view of the support framing of the vaulting board of FIG. 1.
Figure 3:
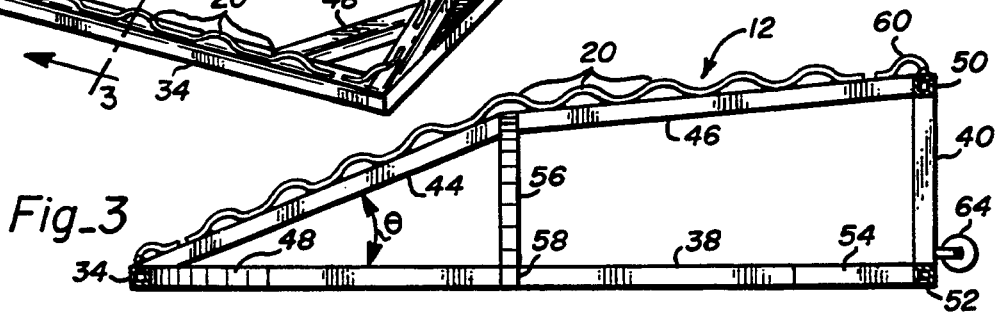
FIG. 3 is a cross-sectional view of the support framing taken along line 3—3 of FIG. 2.

FIG. 1 is a perspective view of a vaulting board of the present invention referred to by the general reference character 10. As illustrated in FIGS. 1–3, the vaulting board 10 includes a ramp framing referred to by the general reference character 12. Positioned over the ramp framing 12 and suspended intermediate therein, is a pliable bed sheet 14. Engaged about the periphery of the bed sheet 14 and interconnected with the framing 12, are a plurality of coil springs 16. The coil springs 16 are connected to the pliable bed sheet 14 by a plurality of D-rings 18 which are in the order of approximately 1½ inches maximum diameter. The opposite end of each of the coil springs 16 is connected to the ramp framing 12 at connecting points 20 such that the springs 16 extend from the outer edges of the bed sheet 14 perpendicularly.

Sewn about the outer edges of the bed sheet 14 is a pliable cover section 24 of a polypropylene material which covers the coil springs 16 and D-rings 18 and a foam pad 26 to form a cushion over the edges of the ramp framing 12. About the periphery of the cover section 24 are sewn a plurality of loops 28. Thus, the pliable sheet 14 forms a rectangular section circumscribed by the rectangular framing of the cover section 24 superimposed over the foam pad 26. The size of the sheet 14 corresponds to that of the ramp surface of a conventional vaulting board.

The ramp framing 12 includes a pair of lateral frames 30 and 32 which are connected at one end to a cross member 34 and at the opposite ends to a cross member 36. Each of the lateral frames 30 and 32 include a longitudinal base member 38, a first riser 40 and a second riser 42. The riser 40 is at one terminal end of the base member 38 and the riser 42 is intermediate the terminal ends of the base member 38. A first ramp brace 44 extends from the cross member 34 to the top of the second riser 42. A second ramp brace 46 extends from the top of the riser 42 to the top of the riser 40. Extending at an angle and engaged to the base member 38 and the cross members 34 are a pair of horizontal cross links 48.

The cross member 36 includes a pair of lateral braces 50 and 52 which project and engage opposite ends of the second risers 42. Extending from the base member 38 to the lateral brace 52 are two horizontal cross links 54. To provide further lateral support, each of the risers 42 are tied to one end of a brace 56 which are engaged to an anchor 58 projecting from the opposite end of the riser 42. Providing further structural support is a rectangular flat base foundation 59 on which the base members 38, cross member 34 and lateral brace 52 are engaged.

Around the top edges of the cross member 34, lateral brace 50, ramp braces 44 and ramp braces 46 is a cable 60 of a metallic material, for example, ¼ inch metallic wire. The cable is spot welded or otherwise anchored to the cross members 34, 36 and risers 40 and 42 at various intervals, for example, six inch spacings. Thus, the cable means 60 forms loops which establish the points 20 at which the coil springs 16 may be engaged beneath the foam pad 26.

A pliable elastic rope 62 is weaved about the loops 28 and the D-rings 18. This rope provides for a further means for controlling the tension within the springs 16 and therefore, the tautness of the bed sheet 14. Also, the pliable rope allows for expansion and extension when the athlete jumps on the sheet 14. This provides for relief of stress and tension on the loops 28 which otherwise occurs when the athlete jumps on the sheet area 14.

To facilitate transport of the vaulting board 10, a pair of wheels 64 are engaged about the cross members 36 and project therefrom such that the lateral member 34 may be elevated vertically. Then, the board 10 may be transported on the wheels 64.

In an embodiment of the vaulting board 10, the ramp framing 12, including the lateral frames 30 and 32, cross members 34 and 36, base members 38, risers 40 and 42, ramp braces 44 and 46, cross links 48 and 54, lateral braces 50 and 52, braces 56 and anchors 58 are all comprised of rectangular metal tubing of 3/32 inches in thickness and configured in a one inch by one inch square. The length of the cross members 34 and 36 is 36.4 inches and the length of the base members 38 is 50.4 inches. The height of riser 40 is eleven inches and that of riser 42 is eight inches. The distance between the riser 40 and riser 42 is twenty-six inches and the distance between the riser 42 and the cross member 34 is 24.4 inches such that the length of the ramp brace 44 is approximately 26.4 inches and the length of the ramp brace 46 is approximately 26.2 inches.

The bed sheet 14 is sixteen inches in width by thirty-two inches in length with the D-rings 18 being spaced approximately 3½ inches apart. Also, one of the D-rings 18 is positioned at each corner of the bed sheet 14.

Though the vaulting board 10 is illustrated as having straight first ramp brace 44 and a straight second ramp brace 46 with each being inclined at a different angle, said braces 44 and 46 may be one homogeneous member shaped in an arc to simulate a conventional vaulting ramp. The vaulting board 10 provides a training vaulting board for use by an athlete in transition to a standard vaulting board and thus, it may be more desirable to make the profile of the lateral frames 30 and 32 arcuate in design.

The vaulting board 10 may be widely used by an athlete during practice sessions. For example, during practice sessions, an athlete will do many repetitions and therefore be jumping onto the vaulting ramp several times. The repeated jumping on standard vaulting ramps provides traumatic shocking to the ankles, lower legs, hips and shins of the athlete. The trauma is increased if the athlete is recovering from injuries. With the vaulting board 10, the tension on the bed sheet 14 is readily adjustable by varying the tension on the rope 62. The foam pad 26 beneath the cover 24 may be in the order of one inch in thickness. Furthermore, the structure provides padding around the peripheral edges and also covers the springs 16 to further guard against injuries if the athlete errs in approaching or utilizing the vaulting board during the run and jump portion of the performance. Likewise, with the coil springs 16 and the pliable elastic rope 62, the bed sheet 14 resumes its normal position and shaping after the athlete leaves the surface during the athlete's jump. The loops 28 further secure the bed sheet 14 and cover section 24 to the framing 12. Likewise, the framing 12 is sturdy and the braces 56 and 58 further resist any internal bending of the lateral frame 32 when subjected to the shock of the athlete jumping on the bed sheet 14. Likewise, the cross links 48 and 54 provide further strengthening and resistance to any internal flexing of the lateral frames 30, 32 or cross member 34, 36.

As illustrated, with the vaulting board 10 the tension within the bed sheet 14 can be adjusted by varying the number of springs 16, and/or the spring tension of the utilized springs 16 and/or the tension on the pliable elastic rope 62.

Although the present invention has been described in terms of the presently preferred embodiment, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. A vaulting board comprising:

a ramp framing (12) having a pair of lateral frames (30, 32) with each lateral frame connected at a first end to opposite ends of a first cross member (34) and at a second end to opposite ends of a second cross member (36) with said first end of each of said lateral frames being at a lower elevation than said second end of each of said lateral frames;

a first plurality of coil springs (16) connected laterally with each of said lateral frames (30, 32);

a second plurality of coil springs (16) connected with said second cross member (36);

a means (68) engaged at intervals to each of said lateral frames (30, 32), said first cross member (34) and said second cross member (36) to form loops positioned peripherally about the ramp framing (12) to receive and anchor one end of the first and second plurality of coil springs (16);

a pliable bed sheet (14) positioned intermediate each of said lateral frames (30, 32) and intermediate said first and second cross members (34, 36);

connector means (18) for connecting each of the first and second plurality of coil springs (16) to the bed sheet (14);

a pliable cover layer (24) positioned over the first and second plurality of coil springs (16) and extending laterally from the bed sheet (14) towards said first and second cross members (34, 36) and said pair of lateral frames (30,32);

a padding (26) connected with and about a top edge of said first and second cross members and said pair of lateral frames;

means connecting the padding (26) and ramp framing (12) to the pliable cover layer (24) about an outer peripheral edge of the pliable cover layer; and tension adjustment means (62) for adjusting tension in the first and second plurality of coil springs (16) and tautness of the bed sheet (14), the tension adjustment means including an elastic rope (62) interwoven between a plurality of loops (28) peripherally positioned about the cover layer (22) and the connector means.

2. The vaulting board of claim 1 wherein, each lateral frame (30, 32) includes a case member (38) having a first and second terminal end, a first riser (40) about said first terminal end of said base member (38) and projecting vertically, a second riser (42) intermediate said first and second terminal ends and projecting vertically from said base member, said second riser (42) being shorter than said first riser (40), a first ramp brace (44) extending from said second terminal end to said second riser (42) and a second ramp brace (46) extending from said second riser to said first riser (40).

3. The vaulting board of claim 2 wherein, a plurality of rings (18) are interconnected to the pliable bed sheet (14) and the first and second plurality of coil springs (16).

4. The vaulting board of claim 1 further including, a wheel assembly (64) engaged to said second cross member (36) whereby when the first cross member (34) is elevated the wheel assembly (64) engages a supporting surface to facilitate transporting the ramp over said surface.

5. The vaulting board of claim 1 further including, tension adjustment means (62) for adjusting tension in the first and second plurality of coil springs (16) and tautness of the bed sheet (14).

6. The vaulting board of claim 1 wherein, the padding (26) is positioned over the first and second plurality of coil springs (16) with the pliable bed sheet (14) at a lower elevation than said padding (26).

7. A vaulting board comprising:

a ramp framing (12) having a pair of lateral frames (30, 32) with each lateral frame connected at a first end to opposite ends of a first cross member (34) and at a second end to opposite ends of a second cross member (36) with said first end of each of said lateral frames being at a lower elevation than said second end of each of said lateral frames, each lateral frame (30, 32) including a base member (38) having a first and second terminal end, a first riser (40) about said first terminal end of said base member (38) and projecting vertically, a second riser (42) intermediate said first and second terminal ends and projecting vertically from said case member, said second riser (42) being shorter than said first riser (40), a first ramp brace (44) extending from said second terminal end to said second riser (42) and a second ramp brace (46) extending from said second riser to said first riser (40);

a first plurality of coil springs (16) connected laterally with each of said lateral frames (30,32);

a second plurality of coil springs (16) connected with said second cross member (36);

a cable means (60) engaged at intervals to each of said lateral frames (30, 32), said first cross member (34) and said second cross member (36) to form loops positioned peripherally about the ramp framing (12) to receive and anchor one end of the first and second plurality of coil springs (16);

a pliable bed sheet (14) positioned intermediate each of said lateral frames (30, 32) and intermediate said first and cross members (34, 36);

connector means (18) for connecting each of the first and second plurality of coil springs (16) to the bed sheet (14), the connector means including a plurality of rings (18) interconnected to the pliable bed sheet (14) and the first and second plurality of coil springs (16);

a pliable cover layer (24) positioned over the first and second plurality of coil springs (16) and extending laterally from the bed sheet (14) towards said first and second cross members. (34, 36) and said pair of lateral frames (30,32);

a padding (26) connected with and about a top edge of said first and second cross members and said pair of lateral frame;

means connecting the padding (26) and ramp framing (12) to the pliable cover layer (24) about an outer peripheral edge of the pliable cover layer; and tension adjustment means (62) for adjusting tension in the first and second plurality of coil springs (16) and tautness of the bed sheet (14), the tension adjustment means including an elastic rope (62) interwoven between a plurality of loops (28) peripherally positioned about the cover layer (22) and the D-rings (18).

8. The vaulting board of claim 7 wherein, said first ramp brace (44) is at a greater inclination angle than the inclination angle of said second ramp brace (46).

9. The vaulting board of claim 7 further including, a first and second cross link (48, 54) interconnecting one of said lateral frames (32) to said first cross member (34) and to said second cross member (36);

a third and fourth cross link (48, 54) interconnecting said other lateral frame (32) to said first cross member (34) and to said second cross member (36).

10. The vaulting board of claim 9 further including, a pliable elastic rope (62) interwoven with said D-rings (18) and peripheral edge of the cover layer (22) to adjust tension of the bed sheet (14).

* * * * *